US006589087B2

(12) United States Patent
Mackal et al.

(10) Patent No.: US 6,589,087 B2
(45) Date of Patent: Jul. 8, 2003

(54) AUTOMATIC INFLATOR WITH STATUS INDICATOR

(75) Inventors: Glenn H. Mackal, St. Petersburg, FL (US); Lyman W. Fawcett, Jr., St. Petersburg, FL (US)

(73) Assignee: Halkey-Roberts Corporation, St. Petersburg, FL (US)

( * ) Notice: Subject to any disclaimer, the term of this patent is extended or adjusted under 35 U.S.C. 154(b) by 0 days.

(21) Appl. No.: 09/948,533

(22) Filed: Sep. 7, 2001

(65) Prior Publication Data

US 2003/0049981 A1 Mar. 13, 2003

(51) Int. Cl.[7] ..... B67B 7/24
(52) U.S. Cl. ..... 441/93; 222/5
(58) Field of Search ..... 441/92, 93; 222/5, 222/23

(56) References Cited

U.S. PATENT DOCUMENTS

| | | | | | |
|---|---|---|---|---|---|
| 3,059,814 | A | | 10/1962 | Poncel et al. | 222/5 |
| 3,091,782 | A | | 6/1963 | Sclafani | 9/316 |
| 3,426,942 | A | | 2/1969 | McMains et al. | 222/5 |
| 3,579,964 | A | | 5/1971 | Ohlestein | 222/5 |
| 3,702,014 | A | | 11/1972 | Rabon et al. | 9/8 |
| 3,757,371 | A | | 9/1973 | Martin | 9/316 |
| 3,809,288 | A | | 5/1974 | Mackal | 222/3 |
| 3,910,457 | A | | 10/1975 | Sutliff et al. | 222/5 |
| 3,997,079 | A | | 12/1976 | Niemann | 222/5 |
| 4,223,805 | A | | 9/1980 | Mackal | 222/5 |
| 4,260,075 | A | | 4/1981 | Mackal | 222/5 |
| 4,267,944 | A | | 5/1981 | Mackal | 222/5 |
| 4,382,231 | A | | 5/1983 | Miller | 324/439 |
| 4,436,159 | A | | 3/1984 | Revay | 169/28 |
| 4,500,014 | A | * | 2/1985 | Zimmerly | 441/92 |
| 4,513,248 | A | | 4/1985 | Miller | 324/439 |
| 4,627,823 | A | | 12/1986 | Mackal | 441/95 |
| 4,688,833 | A | * | 8/1987 | Todd | 285/12 |
| 4,708,370 | A | * | 11/1987 | Todd | 277/615 |
| 4,794,498 | A | * | 12/1988 | Neumeier | 362/186 |
| 4,927,057 | A | * | 5/1990 | Janko et al. | 441/93 |
| 5,026,310 | A | * | 6/1991 | Mackal et al. | 441/92 |
| 5,076,468 | A | | 12/1991 | Mackal | 222/5 |
| 5,098,325 | A | * | 3/1992 | Kim et al. | 441/92 |
| 5,333,756 | A | | 8/1994 | Glasa | 222/5 |
| 5,370,567 | A | | 12/1994 | Glasa | 441/95 |
| 5,413,247 | A | * | 5/1995 | Glasa | 441/93 |
| 5,493,900 | A | | 2/1996 | Glasa | 73/49.2 |
| 5,562,233 | A | | 10/1996 | Glasa | 222/5 |
| 5,597,091 | A | * | 1/1997 | Mah et al. | 222/23 |
| 5,601,124 | A | * | 2/1997 | Weinheimer et al. | 222/5 |
| 5,694,986 | A | | 12/1997 | Weinheimer et al. | 141/19 |
| 5,775,358 | A | | 7/1998 | Fawcett, Jr. et al. | 137/68.18 |
| 5,852,986 | A | * | 12/1998 | Mackal | 222/23 |
| 6,004,177 | A | * | 12/1999 | Biesecker et al. | 441/92 |

FOREIGN PATENT DOCUMENTS

| | | |
|---|---|---|
| EP | 0535299 | 4/1992 |
| EP | 0583746 | 12/1993 |
| EP | 0583747 | 12/1993 |
| EP | 0615093 | 2/1994 |

* cited by examiner

*Primary Examiner*—S. Joseph Morano
*Assistant Examiner*—Lars A. Olson
(74) *Attorney, Agent, or Firm*—Holland & Knight LLP

(57) ABSTRACT

An automatic inflator having a status indicator that indicates whether a fully-charged, unspent gas cylinder has been installed to the automatic inflator, whether a fully-operable bobbin has been properly installed within the automatic inflator and whether the threaded cap of the automatic inflator has been fully installed, including an indicator window that displays the color "green" when the automatic inflator is fully operational automatically or the color "red" when the automatic inflator is at least partially inoperable automatically due to the removal of the gas cylinder, due to at least partial removal of the threaded cap, or due to the firing of the inflator resulting in a spent bobbin or gas cylinder.

16 Claims, 19 Drawing Sheets

126
136
134
128
126
134
128

126
136
134
128
19
19

126
128

126
128

126
128

AUTOMATIC INFLATOR WITH STATUS INDICATOR

BACKGROUND OF THE INVENTION

1. Field of the Invention

This invention relates to automatic inflators for inflating articles such as life rafts, life vests, and the like. More particularly, this invention relates to automatic inflators having indicators that indicate the operating condition of the inflator.

2. Description of the Background Art

Presently, there exists many types of inflators designed to inflate inflatable articles such as personal floatation devices (life vests, rings and horseshoes), life rafts, buoys and emergency signaling equipment. Inflators typically comprise a body for receiving the neck of a cylinder of compressed gas such as carbon dioxide. A reciprocating piercing pin is disposed within the body of the inflator for piercing frangible seal of the cylinder whereupon the compressed gas therein flows into an exhaust manifold of the inflator and then into the article to be inflated. Typically, a manually movable firing lever is operatively connected to the piercing pin such that the piercing pin pierces the frangible seal of the cylinder upon jerking of a ball lanyard. U.S. Pat. No. 3,809,288, the disclosure of which is hereby incorporated by reference herein, illustrates one particular embodiment of a manual inflator.

While manual inflators work suitably well, it was quickly learned that in an emergency situation, the person needing the assistance of the inflatable device, such as a downed aviator, injured person, or man overboard, would fail or be unable to manually activate the inflator. Accordingly, it was realized that a means should be provided for automatically activating the inflator in such an emergency situation.

In response to this realized inadequacy of the prior art manual inflators, water-activated automatic inflators were developed which, when submerged in water, would automatically actuate the piercing pin of the inflator thereby inflating the inflatable device. Typical water-activated automatic inflators comprise a water-activated actuator including a water destructible or dissolvable "bobbin" that holds-back a spring-loaded actuator pin in a cocked position in alignment with the piercing pin. Upon submersion in water, the dissolvable "pill" of the bobbin dissolves whereupon the bobbin releases the cocked actuator pin to strike the piercing pin, either directly or indirectly via an intermediate transfer pin. Upon striking the piercing pin, the pin fractures the seal of the cylinder whereupon the gas flows through the exhaust manifold and into the inflatable device to inflate the same. Representative automatic actuators for inflators are disclosed in U.S. Pat. Nos. 3,059,814; 3,091,782; 3,426,942; 3,579,964; 3,702,014; 3,757,371; 3,910,457; 3,997,079; 4,233,805; 4,267,944; 4,260,075; 4,382,231; 4,436,159; 4,513,248; 4,627,823; and 5,076,468, the disclosures of each of which are hereby incorporated by reference herein.

The above-referenced automatic inflators have been successfully commercialized in many industries. In the marine industry, for example, automatic inflators are commonly incorporated into personal floatation devices, life rafts, buoys, emergency signaling equipment, and the like. Because of the nature of such devices, the reliability of the automatic inflator to work properly during exigent circumstances, is paramount. Unfortunately, devices intended to be used during emergency situations are often stored away, such as in a locker, hold, or well of a boat, and ignored for inordinate periods of time. Further, when eventually removed from storage for maintenance, such emergency devices are commonly inspected and serviced only by yachtsmen and boaters who lack any specialized training or expertise in servicing automatic inflators. Consequently, automatic inflators may be improperly serviced by inadvertently installing a spent gas cylinder or bobbin. Obviously, an automatic inflator that has been improperly serviced, will fail to properly operate during an emergency situation.

Various safety indicators have been developed for indicating the operating condition of automatic inflators and gas cylinders used in connection therewith. For example, as disclosed in U.S. Pat. No. 5,775,358, the disclosure of which is hereby incorporated by reference herein, there exists an indicator system that interconnects between the gas cylinder and the inflator. The one-time, disposable indicator system is responsive to the high pressure release of gas from the cylinder during a discharge and changes from a color "green" signifying the cylinder being charged to a color "red" signifying that the cylinder has been discharged.

As taught by U.S. Pat. No. 5,694,986, the disclosure of which is hereby incorporated by reference herein, status indicators have also been incorporated within automatic actuators for indicating when the automatic actuator is in its "cocked" position armed and ready for firing and when the automatic actuator has been fired. The status indicator incorporated into the automatic inflator as taught by this patent, indicates the existence of or the ready-condition or status of the bobbin within the automatic inflator. However, it is incapable of indicating the charged condition of the gas cylinder.

It should be appreciated that the gas cylinder indicator of U.S. Pat. No. 5,775,358 and the automatic actuator status indicator of U.S. Pat. No. 5,694,986 may be used together with the former indicating the spent condition of the gas cylinder and the latter indicating the spent condition of the bobbin of the automatic actuator. However, it should also be appreciated that the gas cylinder indicator may be indicating "green" representing a fully charged gas cylinder whereas the automatic inflator indicator may be indicating "red" representative of a spent bobbin. Conversely, the gas cylinder indicator may be indicating "red" and the automatic inflator indicator may be indicating "green". Of course, the automatic inflator indicator could be displaying "green" even when the gas cylinder is missing entirely. In such scenarios, it is possible for the yachtsman or boater to visualize only the "green" indication and carelessly fail to recognize the "red" indication. In such an event, the yachtsman or boater would mistakenly believe that the automatic inflator is in full operating condition.

In recognition of the possible confusion of separate status indicators, the United States Coast Guard has mandated that all 1F automatic inflators include a "single-point" status indicator that indicates the overall operating condition of the automatic inflator inclusive of the gas cylinder.

Therefore, it is an object of this invention to provide an improvement which overcomes the aforementioned inadequacies of the prior art programs and provides an improvement which is a significant contribution to the advancement of the automatic inflator art.

Another object of this invention is to provide an automatic inflator for inflating an inflatable article including a gas cylinder indicator for indicating the proper installation of a gas cylinder to the automatic inflator.

Another object of this invention is to provide an automatic inflator for inflating an inflatable article including a gas cylinder indicator that indicates the charged condition of the gas cylinder connected to the automatic inflator.

Another object of this invention is to provide an automatic inflator for inflating an inflatable article including a bobbin indicator that indicates when an operable bobbin has been properly installed within the automatic inflator.

Another object of this invention is to provide an automatic inflator for inflating an inflatable article including a fracturable cylinder adapter connected to the neck of the gas cylinder that is fractured upon firing of the automatic inflator whereupon the then spent cylinder cannot be subsequently reinstalled to the automatic inflator.

Another object of this invention is to provide an automatic inflator for inflating an inflatable article including a cap indicator housing that indicates whether the cap of the automatic inflator has been fully installed onto the body of the automatic inflator.

The foregoing has outlined some of the pertinent objects of the invention. These objects should be construed to me merely illustrative of some of the more prominent features and applications of the intended invention. Many of the beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purposes of summarizing this invention, the invention comprises an automatic inflator having a status indicator that indicates whether a fully-charged, unspent gas cylinder has been installed to the automatic inflator, whether a fully-operable bobbin has been properly installed within the automatic inflator and whether the threaded cap of the automatic inflator has been fully installed. The status indicator comprises a "single point" indicator having an indicator window that displays the color "green" when the automatic inflator is fully operational automatically or the color "red" when the automatic inflator is at least partially inoperable automatically due to the removal of the gas cylinder, due to at least partial removal of the threaded cap, or due to the firing of the inflator resulting in a spent bobbin or gas cylinder.

The invention further comprises an automatic inflator having an elongated threaded cap that threadably engages an elongated tubular portion of the actuator body to achieve a tube-in-tube arrangement that minimizes inadvertent actuation of the automatic actuator when exposed to wet conditions such as water splashes.

Finally, the invention further comprises an improved inflator exhaust manifold for connecting the automatic inflator to the article to be inflated.

More particularly, in its preferred embodiment, the gas cylinder status indicator comprises a cylinder adapter that is threaded onto the threaded neck of the gas cylinder and, preferably, permanently secured in place by means of an adhesive. The cylinder adapter comprises a tubular configuration having bayonet lugs about its outer periphery and a fracturable collar about its inner end. The gas cylinder status indicator further comprises bayonet slots formed in the boss of the body of the automatic actuator for removable coupling of the cylinder adapter to the inflator body through a conventional push, twist and lock bayonet connection.

The cylinder status indicator further comprises a spring-loaded reciprocating member mounted in axial alignment with the boss of the inflator body. The reciprocating member includes upstanding arms that engage through corresponding holes in the longitudinal wall of the boss of the inflator body. The upstanding arms of the member are forcibly retracted within the boss against the force of the spring by a fracturable collar of the cylinder adapter as the gas cylinder is bayonet-installed into the boss. Upon firing of the gas cylinder, the upstanding arms of the member are forced outwardly from the boss to forcibly fracture the collar of the cylinder adapter. To assure that a spent gas cylinder (i.e., a gas cylinder with a fractured collar) is not re-installed, the reciprocating member includes an upstanding blocking arm that reciprocates within another hole in the longitudinal wall of the boss to move into a blocking position within the bayonet slot when the reciprocating member is forced forwardly upon firing (i.e., not retracted into the inflator body by the collar of the cylinder adapter).

The reciprocating member additionally includes a sidewise projecting shutter, preferably colored "red", that moves from an obscured position across the indicator window formed in the body as the reciprocating member is forced forwardly upon firing. It is noted that the upstanding arms and the upstanding blocking arm are also preferably colored "red" (along with the red-colored shutter) to provide a visual indication when the upstanding arms are in their extended position from the boss and when the blocking arm is blocking the bayonet slot.

The bobbin indicator comprises an elongated headed plug positioned in the inflator body in alignment with the spring-loaded actuator pin that is held-back in a cocked position by an operable bobbin. The head of the bobbin indicator is preferably colored "green" and the length of the bobbin indicator plug is such that when the spring-loaded actuator pin is being held-back into its cocked position by an operable bobbin, the green head of the bobbin indicator plug is in alignment with the indicator window, thereby representing an operable firing position for the bobbin. Conversely, upon firing of the inflator, the spring-loaded actuator pin is released by the bobbin and forcibly engages the bobbin indicator plug to force it axially within the body to a position where the green head thereof is no longer in view within the indicator window. Simultaneously, through the use of a pivotal transfer lever, the reciprocating member of the reciprocating member of the cylinder indicator is forced outwardly whereupon its red shutter moves into the indicator window to indicate an inoperable inflator condition.

The cap indicator for indicating when the threaded cap has been fully threaded onto the inflator body, comprises a tabbed axial sleeve concentrically positioned about the green bobbin indicator. The tabs of the cap axial sleeve extend through corresponding holes formed in the lowermost portion of the threaded tubular portion of the body. As the threaded cap is fully threaded onto the threaded tubular portion of the body to the point of bottoming-out, the protruding tabs are forced longitudinally inwardly. As the protruding tabs are forced inwardly, a window formed in the sleeve is moved into alignment with the indicator window of the valve body. When aligned, the green head of the bobbin indicator plug can be viewed through the indicator window and through the aligned window of the cap indicator whereas when the cap is at least partially unthreaded, the window of the sleeve is no longer in alignment and a side wall, preferably colored "red", of the sleeve appears in the indicator window, thereby indicating an inoperable inflator (i.e., the cap is not fully installed).

It should be appreciated that the red indicator shutter of the reciprocating member of the gas cylinder indicator, the red colored side and the window of the sleeve of the cap indicator, and the green head of the plug of the bobbin indicator function in an overlapping layered but independent manner with respect to each other to be viewable from the single indicator window. Specifically, the indicator states are displayed as follows.

1. If the gas cylinder is missing or if a discharged gas cylinder is installed, the red indicator shutter of the reciprocating member of the gas cylinder indicator, being the topmost layer relative to the indicator window, indicates an inoperable condition of the inflator even if the bobbin indicator and cap indicator would otherwise indicate an operable and a fully engaged cap;
2. Even when the red indicator shutter of the reciprocating member of the gas cylinder is moved out from view of the indicator window (i.e., a charged gas cylinder is installed), the red colored side of the sleeve of the cap indicator appears in view in the indicator window indicating an inoperable condition if the cap is not fully threaded into position;
3. If the red indicator shutter of the reciprocating member of the gas cylinder is moved out from view of the indicator window (i.e., a charged gas cylinder is installed), if the cap is fully threaded into position and if an operable bobbin is installed to hold-back the actuator pin in a cocked position, the window of the sleeve of the cap indicator is in alignment with the indicator window allowing visualization of the green head of the bobbin indicator plug; and
4. Upon firing of the inflator, the actuator pin forces the bobbin indicator pin inwardly to pivot (i.e., seesaw) the transfer lever which then forces the reciprocating member and its arms forwardly whereupon the red indicator shutter into view in the indicator window to indicate an inoperable condition of the inflator.

Thus, it should be appreciated that in all operating states of the inflator, the indicator window presents a single-point status indication of the inflator.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be greatly appreciated by those skilled in the art that the conception and the specific embodiment disclosed may be readily utilized as a basis for modifying or designing other methods for carrying out the same purposes of the present invention. It should also be realized by those skilled in the art that such equivalent methods do not depart from the spirit and scope of the invention as set forth in the appended claims. dr

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several figures.

DETAILED DESCRIPTION OF THE PREFERRED EMBODIMENT

Figure 1:
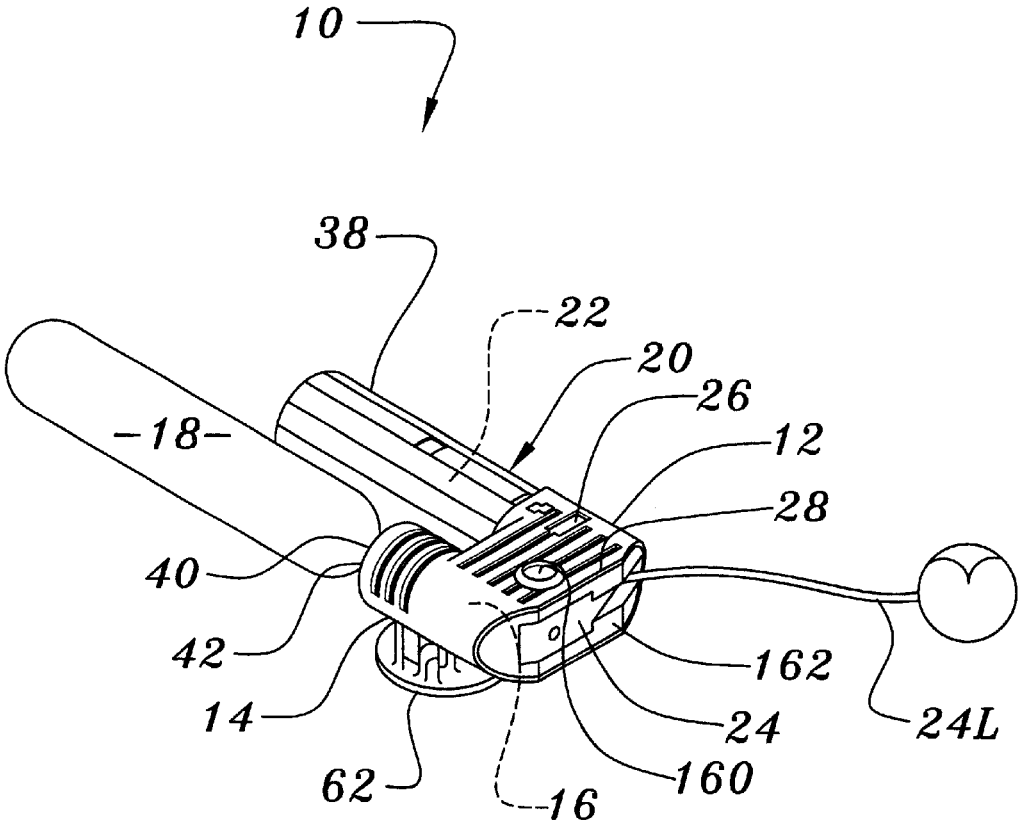
FIG. 1 is a perspective view of the automatic inflator of the invention.

Referring to FIG. 1, the automatic inflator 10 of the invention comprises a generally rectangular hollow body 12 with a boss 14 containing a pierce pin assembly 16 for receiving a gas cylinder 18 and a tubular portion 20 containing an water-activated actuator assembly 22 that forcibly actuates the piece pin assembly 16 by means of an internal pivotal transfer lever 24 upon submersion in water. The internal transfer lever 24 is provided with a tab or ball lanyard 24L for manual actuation.

An indicator window 26 is positioned through the side wall 28 of the inflator body 12 to indicate the firing condition of the inflator 10. Specifically, the inflator 12 includes a gas cylinder indicator 30 that indicates via the indicator window 26 whether a charged gas cylinder 18 is connected to the boss 14 of the inflator 10, a bobbin indicator 32 that indicates via the indicator window 26 whether an operable bobbin 34 is installed in the water-activated actuator assembly 22, and a cap indicator 36 that indicates via the indicator window 26 whether the threaded cap 38 is fully installed onto the tubular portion 20.

The gas cylinder indicator 30 includes a cylinder adaptor 40 that is threaded onto the neck 42 of the gas cylinder 18. The cylinder adaptor 40 cooperates with the other cylinder indicator 30 components within the boss 14 of the inflator 10 to not only provide the cylinder status via the indicator window 26 but also prevents, through the use of a fracturable collar 44 that is fractured upon firing, a spent gas cylinder 18 from being reinstalled onto the boss 14 of the inflator 10.

For clarity in understanding the structure and operation of the inflator 10, the various components of the inflator 10 are first described separately and then the positions of the various indicators are described in relation to the inflator's fully-operational condition and then in its "fired" condition. The positions of the indicators are then described for cylinder-removed and cap-off inoperable conditions.

Figure 3:
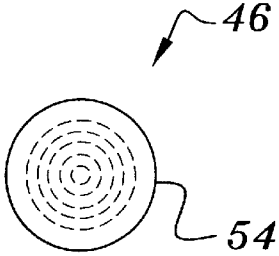
FIGS. 2 and 3 are side and end views, respectively, of the pierce pin shaft preferably employed in the automatic inflator of the invention.
Figure 2:
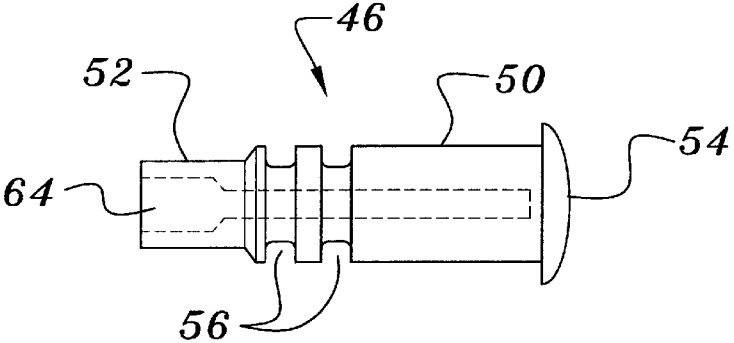
Figure 32:
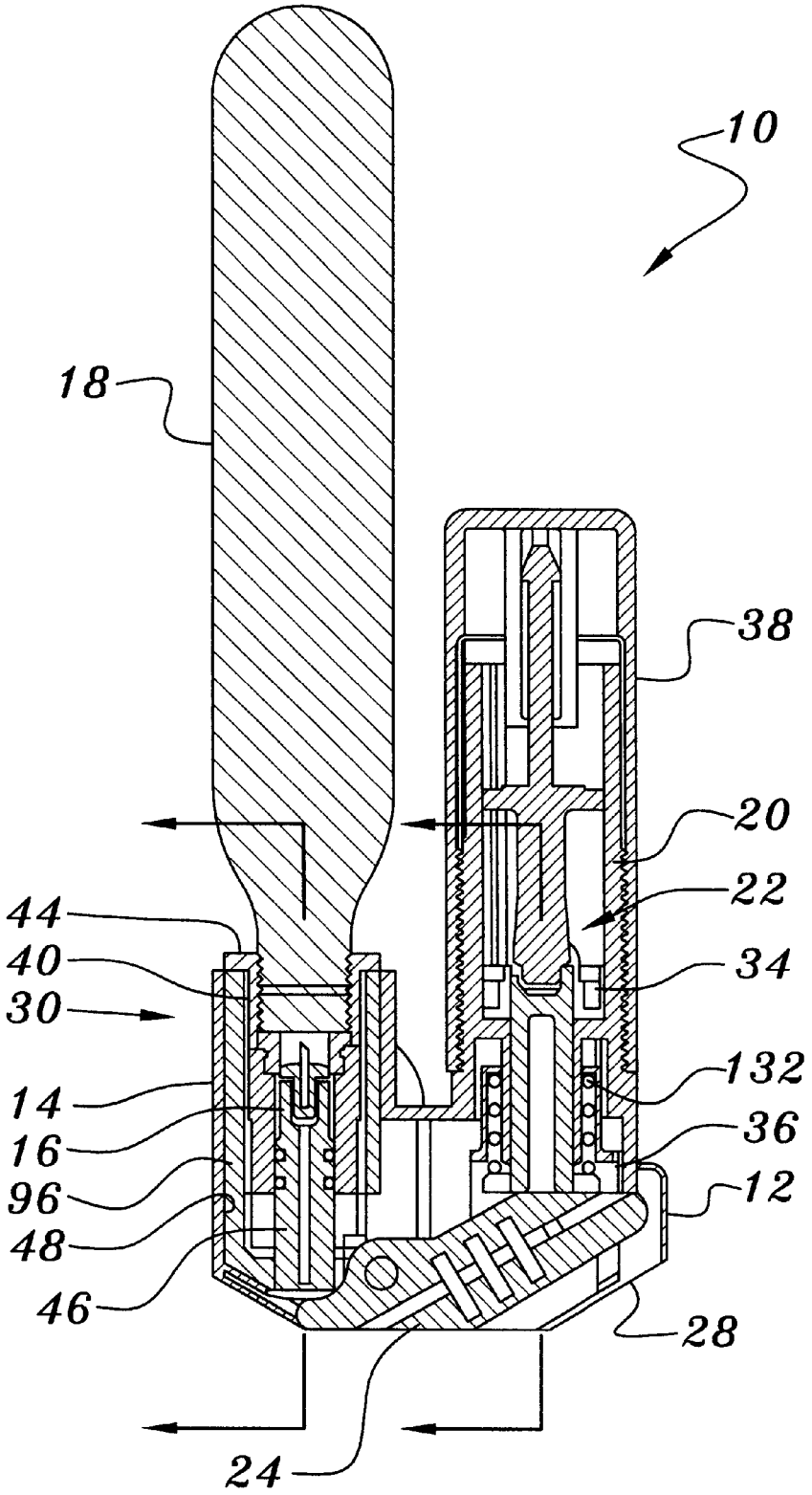
FIGS. 32, 33 and 34 are cross-sectional views of the automatic inflator of the invention in a fully armed condition.
Figure 35:
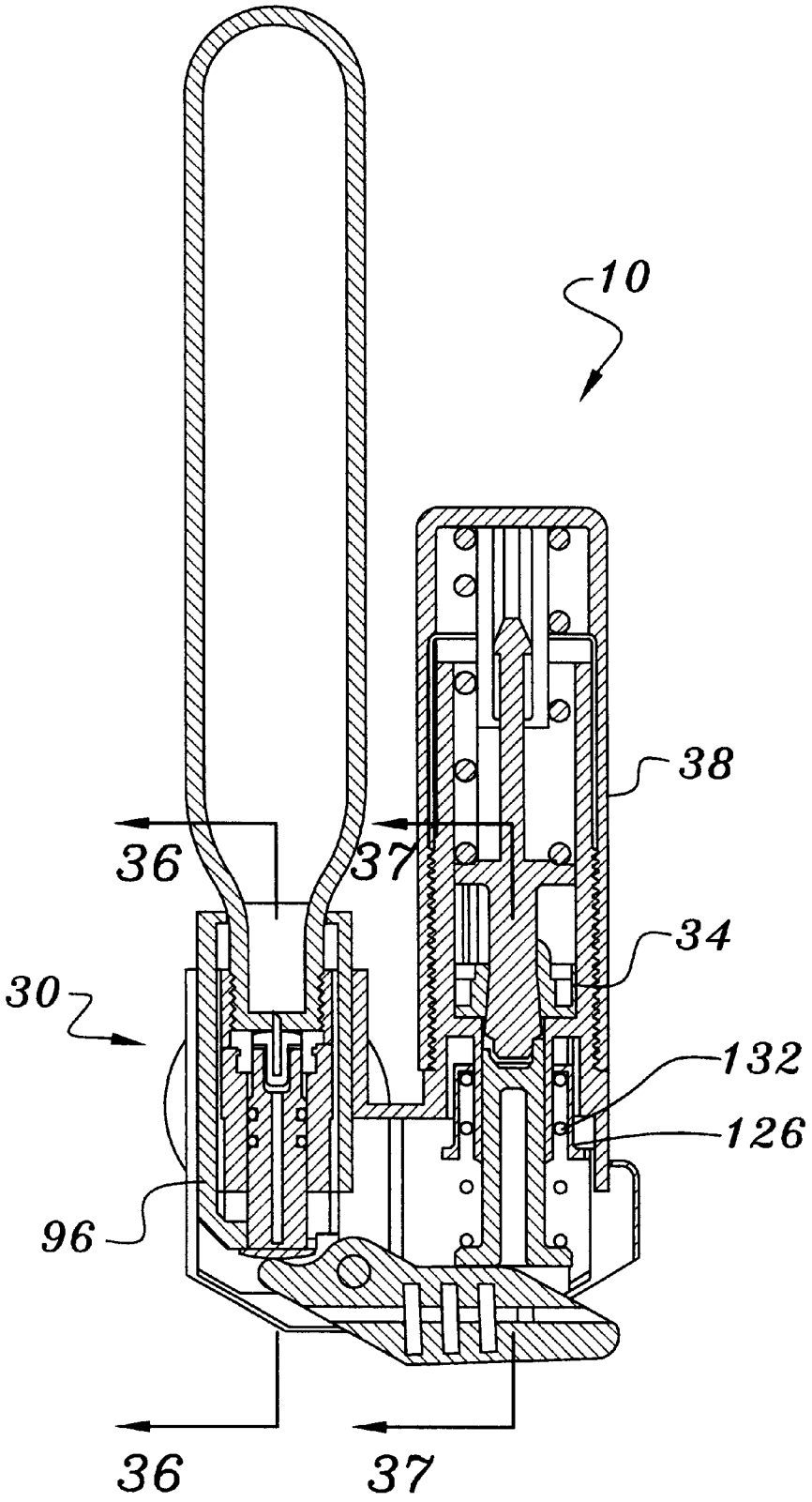
FIGS. 35, 36 and 37 are cross-sectional views of the automatic inflator of the invention in a fired, inoperable condition.
Figure 41:
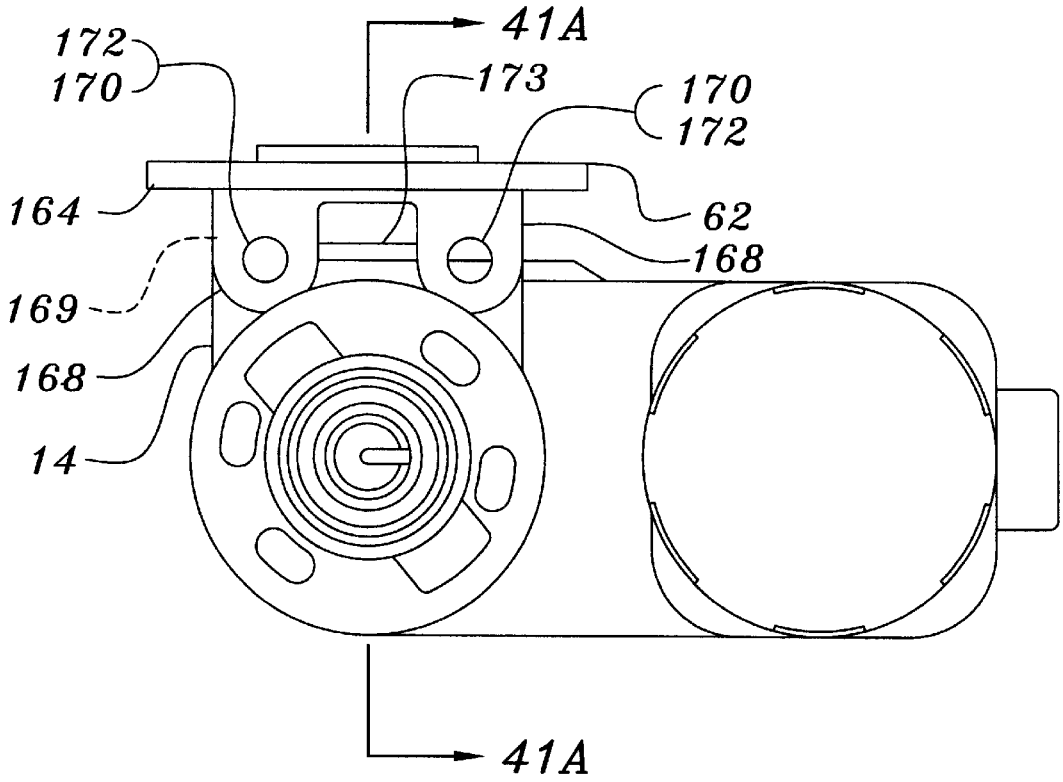

Pierce Pin Shaft (Component FIGS. 2 and 3 and Assembly FIGS. 32, 35 & 41)

The pierce pin shaft 46 includes a generally elongated configuration that is reciprocatingly positioned within the longitudinal bore 48 of the boss 14. The pierce pin shaft 46 includes an increased diameter portion 50 and a reduced diameter portion 52. A dome-shaped head 54 is formed at the end of the increased diameter portion 50. A pair of O-ring slots 56 are formed at the other end of the increased diameter portion 50 for receiving conventional O-rings 58. The spacings between the O-rings slots 56 and hence the O-rings 58, is sufficient to span an exhaust hole 60 formed through the wall 62 of the boss 14 leading from the longitudinal bore 48 to an exhaust manifold 62. In this manner, with the pierce pin shaft 46 fully forwardly positioned within the longitudinal bore 48 after removal of the gas cylinder 18 (see FIG. 41), the O-rings 58 straddle the exhaust hole 60 thereby preventing leakage of gas from the inflated article through the exhaust hole 60 and longitudinal bore 48 to the atmosphere.

The reduced-diameter portion 52 of the pierce pin shaft 46 includes an axial blind hole 64 for receiving a pierce pin 66.

Figure 5:
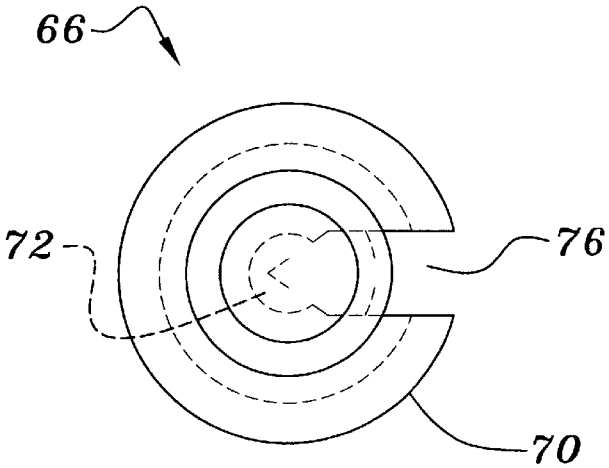
FIGS. 4 and 5 are side and end views, respectively, of the pierce pin preferably employed in the automatic inflator of the invention.
Figure 4:
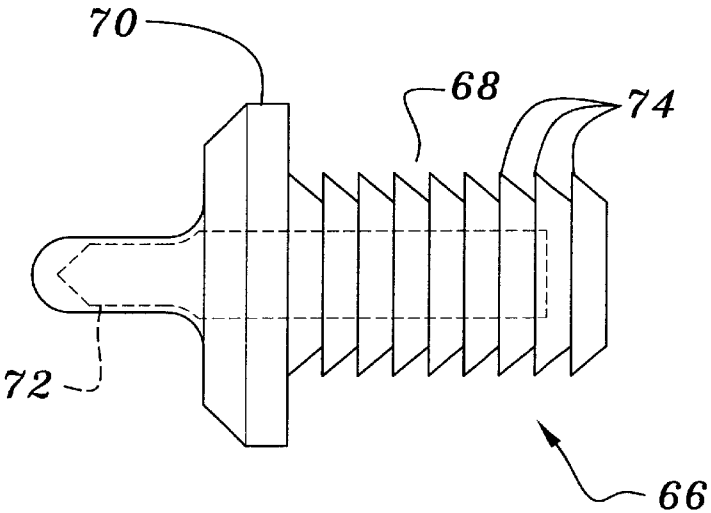
Figure 7:
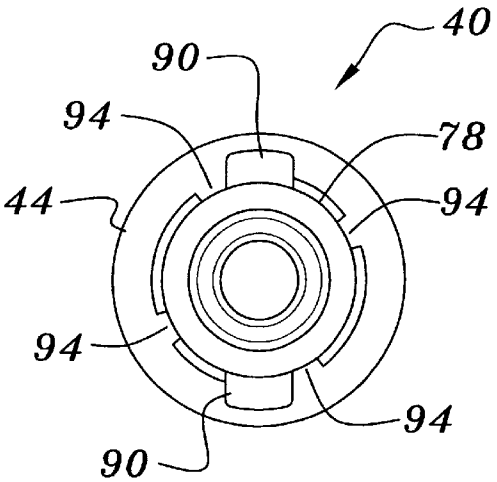
FIGS. 6, 7, 8 and 9 are side, end views, respectively, and a diametrical cross-sectional view of the cylinder adaptor of the cylinder indicator preferably employed in the automatic inflator of the invention.
Figure 8:
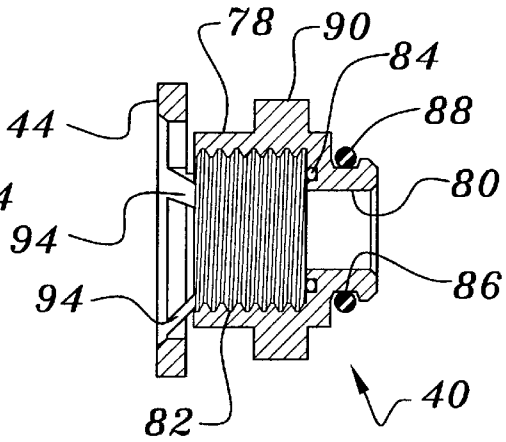
Figure 6:
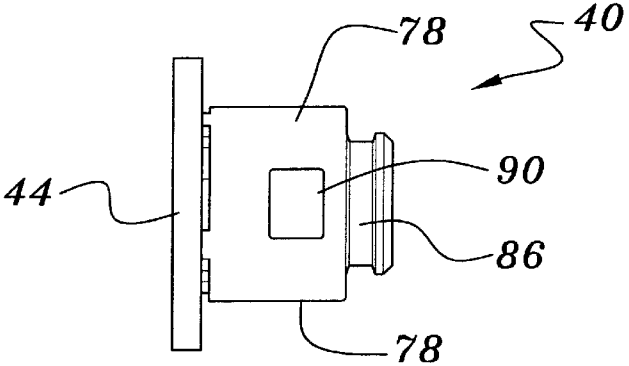
Figure 9:
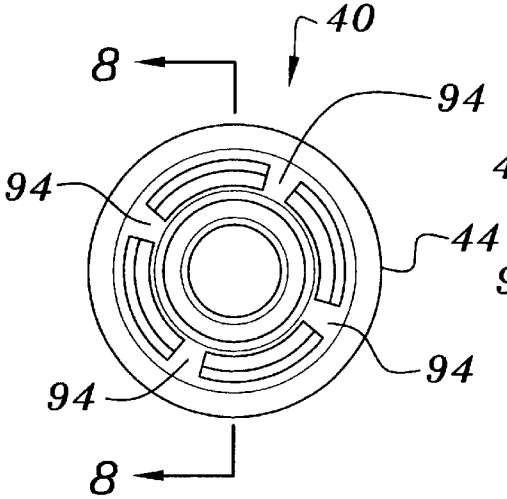
Figure 36:
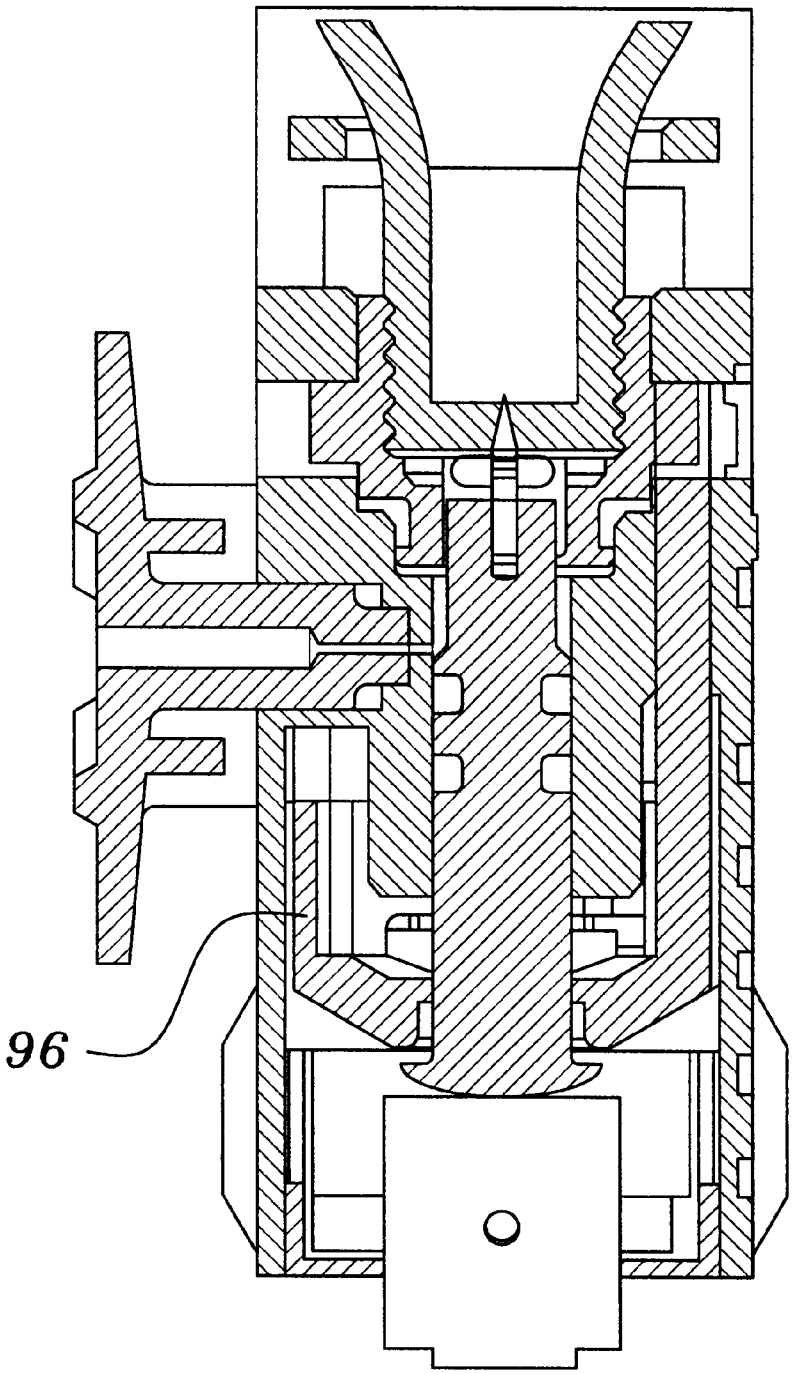

Pierce Pin (Component FIGS. 4 and 5 and Assembly FIGS. 32, 35 & 36)

The pierce pin 66 comprises a generally cylindrical base portion 68, a dome-shaped head portion 70 and a sharp piercing tip 72. The pierce pin 66 is preferably composed of a metal of sufficient hardness such that the piercing tip 72 is capable of piercing the frangible seal of the gas cylinder 18. The base portion 68 includes a plurality of annular ridges 74 having sharp edges formed in the direction of the piercing tip 72. The outer diameter of the annular ridges 74 is dimensioned to be permanently staked into the blind hole 64 of the pierce pin shaft 46. A longitudinal slot 76 is formed along the length of the pierce pin tip 72 and head portion 70 to allow, upon firing, the flow of gas from the gas cylinder 18 through the pierce pin 66 and then past the reduced diameter portion 52 of the pierce pin shaft 46 into the exhaust hole 60 and manifold 62 to inflate the inflatable article (see FIG. 36).

Figure 33:
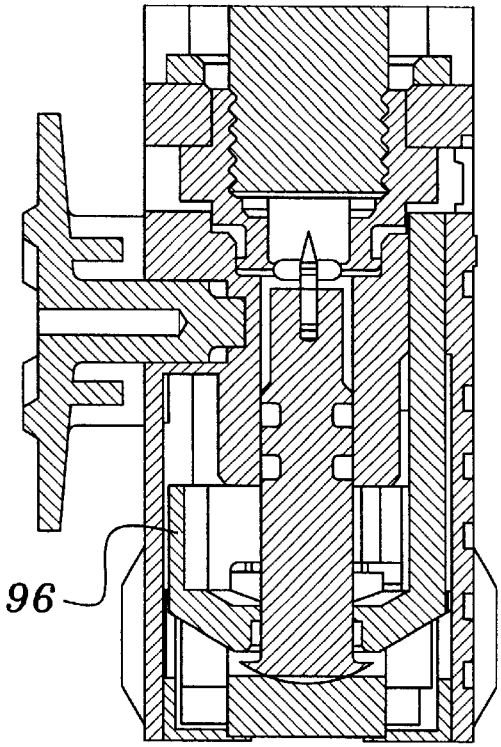

Cylinder Adapter (Component FIGS. 6–9 and Assembly FIGS. 33, 35 & 41)

The cylinder adapter 40 is one component of the gas cylinder indicator 30 that cooperates with the other component (the reciprocating member) of the gas cylinder indicator 30 inside the boss 14 of the inflator 10. The cylinder adapter 40 comprises a generally cylindrical base portion 78 having a longitudinal bore 80 with internal threads 82 for threadably receiving the threaded neck of the gas cylinder 18 and sealing it into position by means of an O-ring 84. Preferably an adhesive is used for a permanent, non-removable threaded connection. The base portion 78 includes an annular slot 86 for receiving an O-ring 88 for sealing the base portion 78 within the longitudinal bore 48 of the boss 14 of the inflator 10 when inserted therein.

The cylinder adapter 40 includes a pair of bayonet lugs 90 formed diametrically on opposing outer surfaces of its base portion 78. The bayonet lugs 90 are dimensioned and configured for insertion within complementary bayonet slots 92 formed in the wall 62 of the longitudinal bore 48 of the boss 14 of the inflator 10 through a conventional push, twist and lock bayonet movement thereby allowing the cylinder adapter 40 and the gas cylinder 18 threaded thereto to be conveniently bayonet-coupled axially to the boss 18 of the inflator 10.

The end of the cylinder adapter 40 comprises an annular fractuable collar 44 which is connected to the base portion 78 by means of a plurality of radial fracturable webs 94. The size and thickness of the webs 94 are designed to have sufficient strength to push the spring-loaded components of the cylinder indicator 30 inwardly inside the boss 14 as the cylinder adapter 40 is bayonet-coupled to the boss of the boss 14 yet of sufficient weakness to be forcibly fractured by the components of the cylinder indicator 30 (i.e., the arms 102 of the reciprocating member 96 described below) that extend from the boss 18 upon firing of the inflator 10.

Without departing from the spirit and scope of the invention, in lieu of the webs 94, the fracturable collar 44 may comprise an annular collar with fracturable segments that are fractured by the arms 102 of the reciprocating member 96 upon firing of the inflator. Alternatively, in lieu of the webs 94, the fracturable collar 44 may comprise a configuration that snap fits into the base portion 78 and that can be releasably fractured or snapped apart upon firing.

Figure 12:
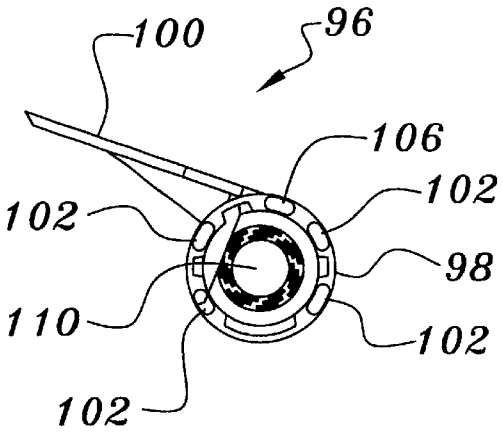
FIGS. 10, 11 and 12 are side views and an end view, respectively, of the reciprocating member of the cylinder indicator preferably employed in the automatic inflator of the invention.
Figure 11:
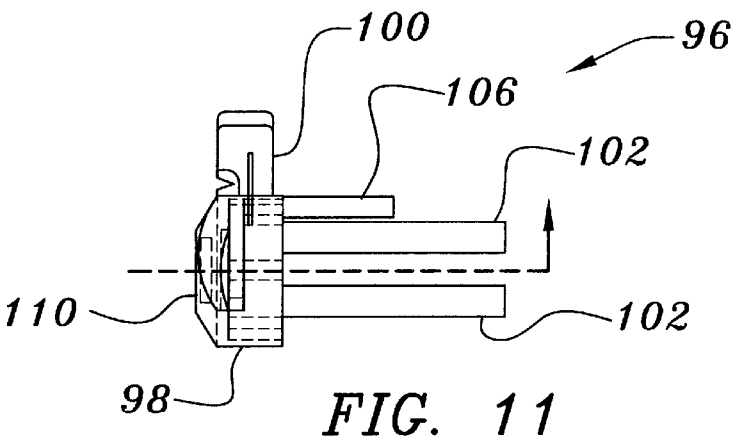
Figure 10:
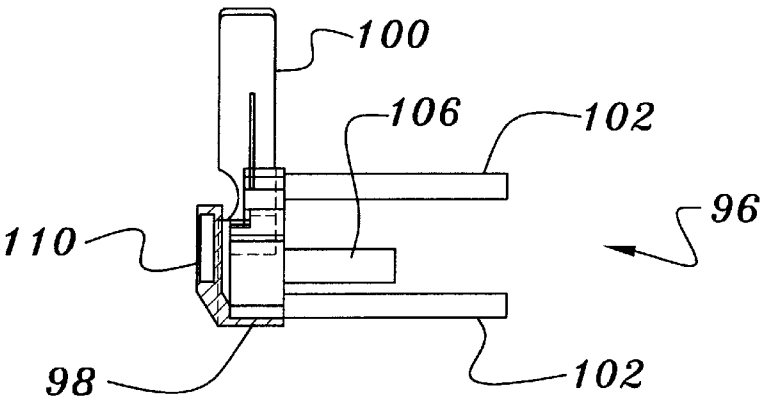
Figure 15:
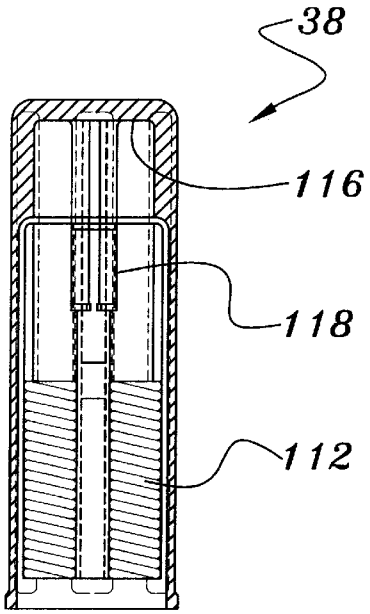
FIGS. 13, 14, and 15 are end, side and diametrical cross-sectional views, respectively, of the cylinder adaptor of the threaded cap preferably employed in the automatic inflator of the invention.

Cylinder Indicator Reciprocating Member (Component FIGS. 10–12 and Assembly FIGS. 33, 35 & 41)

As noted above, the cylinder adapter 40 is one component of the gas cylinder indicator 30 that cooperates with the other component (the reciprocating member 96) of the gas cylinder indicator 30 inside the boss 14 of the inflator 10. The reciprocating member 96 comprises a dome portion 98 having an indicator shutter 100 extending tangentially therefrom and a plurality of upstanding arms 102 (e.g., four) extending parallel to the axis of the dome portion 98. The length and width of the indicator shutter 100 is sufficient to extend from the dome portion 98 across body 12 to the indicator window 26 so as to be visible thereto when aligned therewith. The shutter 100 is formed tangentially relative to the dome portion 98 so as to provide sufficient room inside the body 12 for the transfer lever 102 (described below) to fully operate. The dome portion 98 may further comprise a slot 99 for additional clearance.

The upstanding arms 102 of the reciprocating member 96 are of sufficient length to extend through corresponding holes 104 formed in the wall 62 of the boss 14 of the inflator body 12 and engage the fracturable collar 44 of the cylinder adapter 40 as described above.

The reciprocating member 96 also comprises a blocking arm 106 extending axially from the dome portion 98 parallel to the upstanding arms 102 for reciprocating passage through a hole 108 formed in the wall 62 of the boss 14 in alignment with one of the bayonet slots 92. The length of the blocking arm 106 relative to the length of the upstanding arms 102 is such that it enters the bayonet slot 92 and blocks the bayonet lug 90 of the cylinder adapter 40 from being bayonet-coupled to the boss 14 of the inflator 10 if the fracturable collar 44 of the cylinder adapter 40 has been fractured (see FIG. 41).

If the fracturable collar 44 of the cylinder adapter 40 has not been fractured, the collar 44 forces the reciprocating member 96 via the upstanding arms 102 to a position fully retracted within the boss 14 and body 12. Simultaneously, the blocking arm 106 is retracted to a non-blocking position allowing the cylinder adapter 40 to be bayonet-coupled to the inflator 10.

The dome portion 98 comprises an axial hole 110 of a diameter to loosely receive the pierce pin shaft 46 with the head 54 thereof being seated on the surface of the dome portion 98. In this manner, once the inflator 10 is fired upon immersion in water and the transfer lever 24 is forcibly pivoted thereby to engage the head 54 of the pierce pin shaft 46, the reciprocating member 96 is likewise forcibly moved from its retracted position within the boss 14 to the extended position with the upstanding arms 102 being forcibly moved out of the boss 14 into engagement with the collar 44. Thus, while moving to the extended position, the upstanding arms 102 forcibly fractures the collar 44 of the cylinder adapter 40 and, simultaneously, the indicator shutter 100 moves into alignment with the indicator window 26. With the reciprocating member 96 being colored "red", it is readily seen that upon firing of the inflator 10, the red indicator shutter 100, being now visible through the indicator window 26, visually indicates an inoperable condition. Further, the red upstanding arms 102 extending from the end of the boss 14 and the blocking arm 106 being visible in the bayonet slot 92 likewise indicate an inoperable condition.

Figure 13:
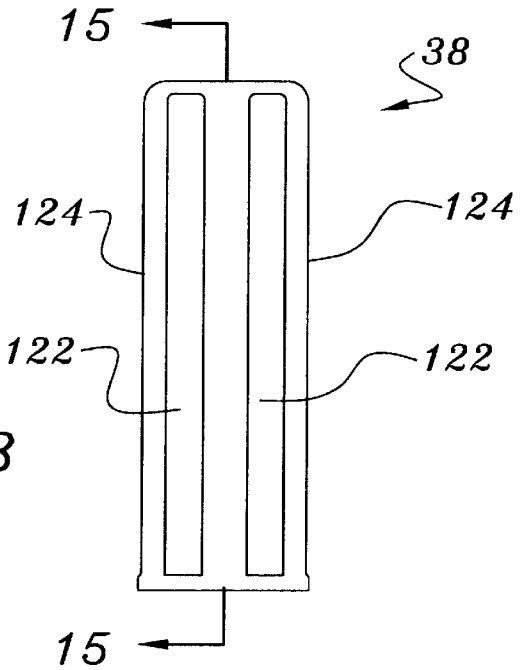
Figure 14:
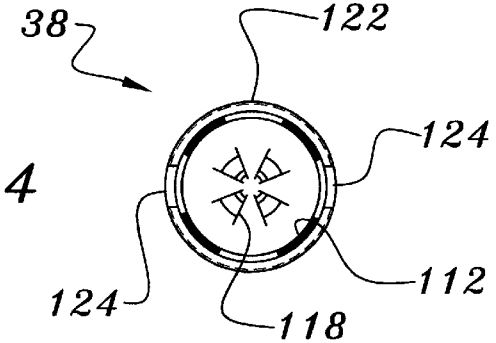
Figures 16, 17, 18, 19, 20:
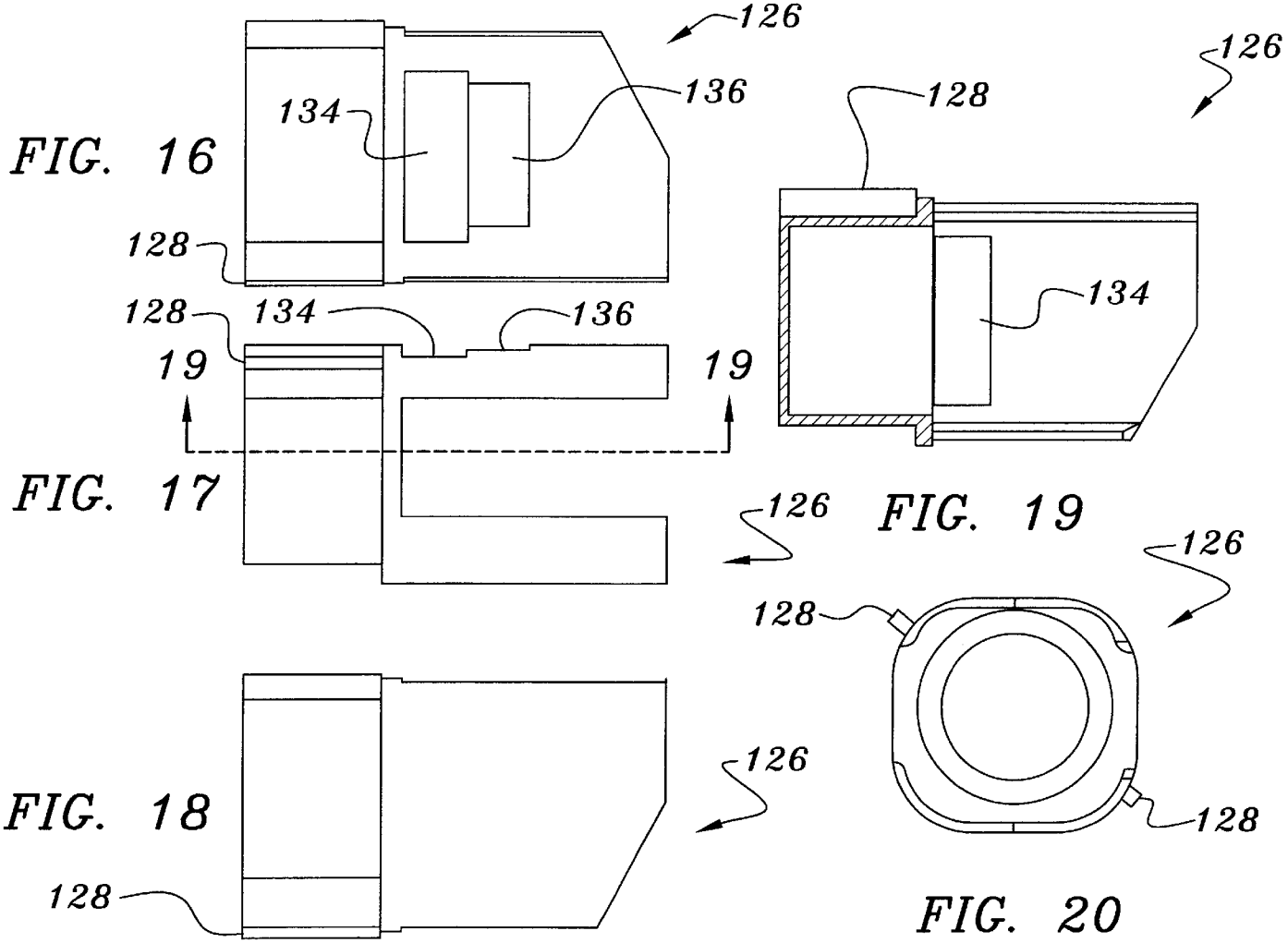
FIGS. 16, 17, 18, 19 and 20 are side views, a diametrical cross-sectional view and an end view, respectively, of the sleeve of the cap indicator preferably employed in the automatic inflator of the invention.

Threaded Cap (Component FIGS. 13–14 and Assembly FIGS. 32, 38, 39 and 42)

The threaded cap 38 of the inflator 10 includes a generally elongated configuration with internal threads 112 for threaded engagement with the external threads 114 of the tubular portion 20 of the inflator body 12. Positioned axially within the cap 38 and extending from the bottom wall 116 thereof, is an elongated retainer 118 for removably receiving the actuator pin 120 (see below) therein and allowing it to slide axially within the retainer 118 by a distance substantially equal to the length of the retainer 118. The outer surface of the cap 38 may include longitudinal recesses 122 to assist in the grasping of the cap 38 during assembly.

Importantly, the cap includes 38 opposing flood holes 124 (see FIG. 42), approximately midway along its length. Each flood hole 124 allows water to flow therethrough into the bobbin 34 to dissolve the pill thereof immediately upon submersion of the inflator 10 in water. However, in order to minimize inadvertent actuation from splashing, it is noted that the length of the tubular portion 20 as well as the cap 38 is significant so as to produce a tube-in-tube configuration with the flood holes 124 being positioned approximately midway thereof. With the inflator 10 being stored in an upright position, it should be readily seen that inadvertent splashing may result in water entering the flood holes 124 but, due to the substantial length of the tubular portion 20, with its uppermost end 20E extending substantially above the flood holes 124, would effectively preclude from such water reaching the bobbin 34 and causing premature actuation.

Cap Indicator Sleeve (Component FIGS. 16–20 and Assembly FIGS. 34, 37, 38 & 39)

The cap indicator 36 indicates when the threaded cap 38 has been fully threaded onto the tubular portion 20 of the inflator 10. The cap indicator 36 comprises a spring-loaded tabbed axial sleeve 126 concentrically positioned about the bobbin indicator plug 154 (see below) in axial alignment with the tubular portion 20. The tabs 128 of the sleeve 126 extend through and protrude from corresponding slots 130 formed in the lowermost portion of the tubular portion 20. The sleeve 126 is resiliently biased in the direction toward the tubular portion 20 by means of a spring 132 concentrically entrained between the sleeve 126 and the head 156 of the plug 154 (see FIG. 37).

The tabs 128 and slots 130 are in alignment with the threads 114 of the tubular portion 20 such that, as the threaded cap 38 is fully threaded onto the threads 114 of the tubular portion 20 to the point of bottoming-out, the protruding tabs 128 are engaged by the lowermost edge of the cap 38 and the sleeve 126 is forced axially away from the tubular portion 20 against the force of the spring 132. As the sleeve 126 is forced away, a window 134 formed in the sleeve 126 is moved into alignment with the indicator window 26 of the inflator body 12.

Thus, it should be appreciated that when the cap 38 is not fully threaded onto the tubular portion 20, the sleeve 126 is moved outwardly by the spring 126 whereupon the red side 136 of the red sleeve 126 is visible through the indicator window 26 to indicate a non-operable condition. However, when the cap 38 is fully threaded onto the tubular portion 20, the window 134 becomes aligned with the indicator window 26 thereby no longer indicating a non-operable condition.

Figure 22:
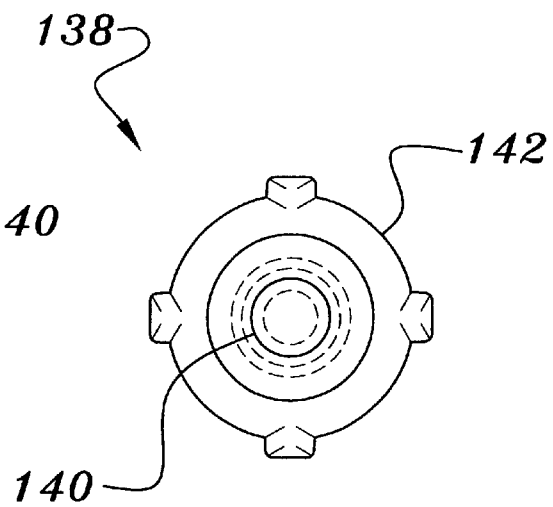
FIGS. 21 and 22 are side and end views, respectively, of the actuator pin of the water-activated actuator assembly preferably employed in the automatic inflator of the invention.
Figure 21:
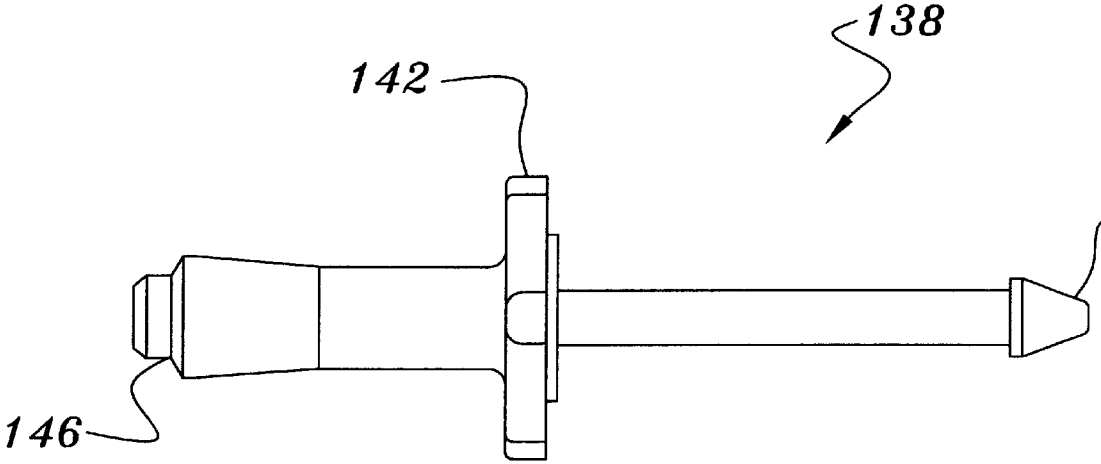

Actuator Pin (Component FIGS. 21 and 22 and Assembly FIGS. 32 and 35)

The actuator pin 138 includes a generally elongated configuration having at its upper end a protrusion 140 for snap-fitting into the retainer 118 formed in the cap 38. The actuator pin 128 further includes a stop flange 142 allowing a heavy-duty spring 144 to be captured between the stop flange 142 and the bottom wall 116 of the cap 38 as the actuator pin 138 is snap-fitted into the retainer 118.

The other end of the actuator pin 138 comprises a seat portion 146 which is dimensioned and configured to seat within the seat of an operable bobbin 34 in such a manner that as the cap 38 is threaded onto the tubular portion 20 with an operable 34 bobbin installed, the seat portion 146 engages thereagainst and the spring 144 captured between the stop flange 142 and the bottom wall 116 of the cap 38 is forcibly compressed. It is noted that when the bobbin 34 is submerged in water, it releases the now spring-loaded actuator pin 138 by unseating the seat portion 146 whereupon the actuator pin 138 forcibly moves inwardly to fire the actuator 10.

Figure 23:
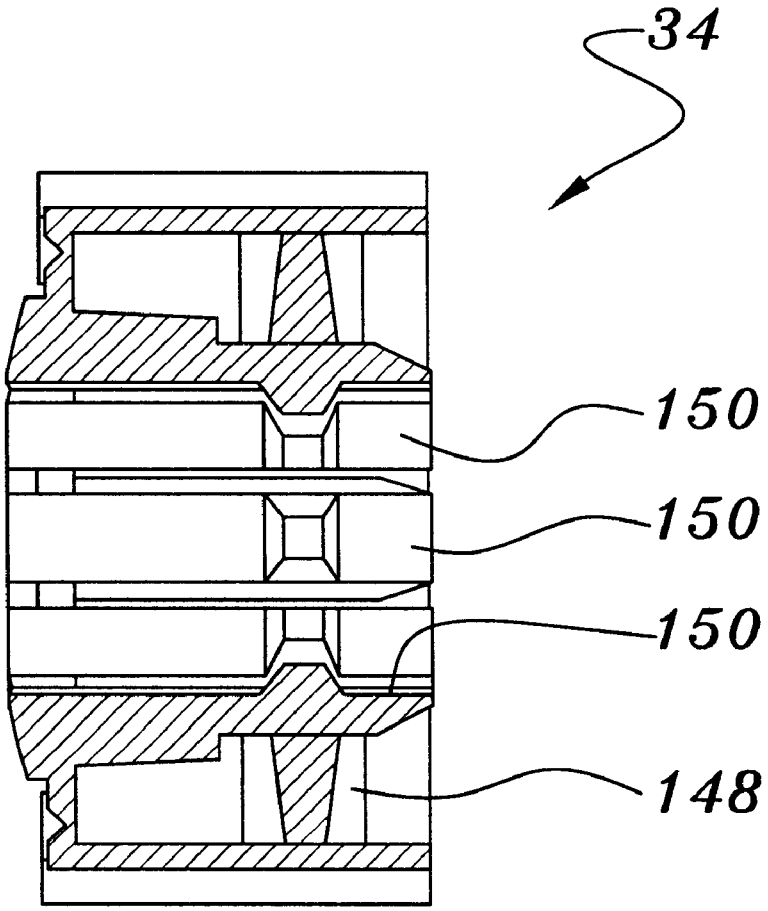
FIG. 23 is a diametrical cross-sectional view of a bobbin of the water-activated actuator assembly preferably employed in the automatic inflator of the invention.

Bobbin (Component FIG. 23 and Assembly FIGS. 32 and 35)

The bobbin 34 comprises a cylindrical configuration containing a water-dissolvable or destructible pill 148 that supports a plurality of arms 150 is a parallel position to define a seat 152 into which the seat portion 146 of the actuator pin 138 is seated and held-back against the force of the compression spring 144. Once the pill 148 is subjected to water as in the case of submerging the inflator 10, the pill 148 looses its ability to support the arms 150 to hold-back the actuator pin 138 and the pin 138 forcibly moves forward to strike the bobbin indicator plug 154. A more complete description of the bobbin 34 and an improved pill 148 is set forth in the patent application, the disclosure of which is hereby incorporated by reference herein, entitled "Bobbin for Automatic Inflators" filed concurrently herewith by the same inventors of this application.

Figure 26:
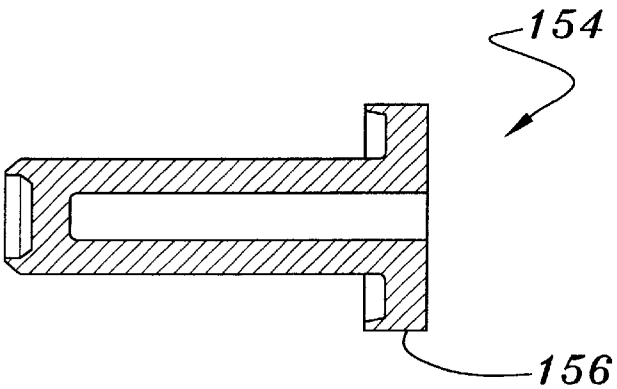
FIGS. 24, 25 and 26 are end, side and diametrical cross-sectional views, respectively, of the plug of the bobbin indicator preferably employed in the automatic inflator of the invention.
Figure 25:
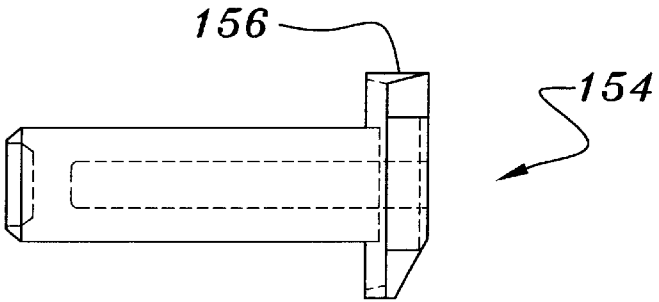
Figure 24:
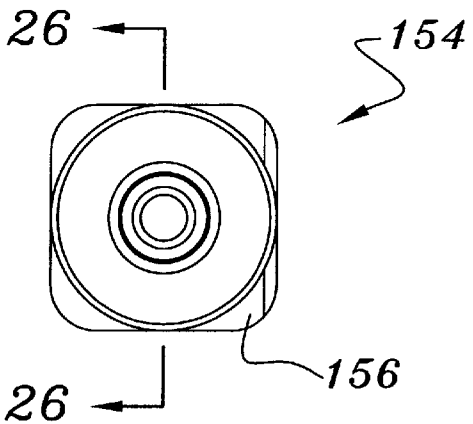
Figure 34:
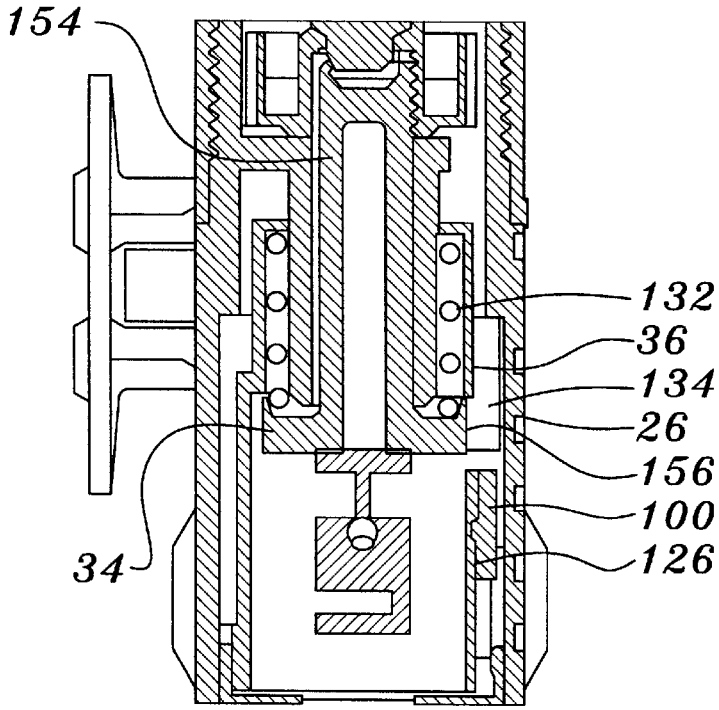

Bobbin Indicator Plug (Component FIGS. 24–26 and Assembly FIGS. 32, 34 and 35)

The bobbin indicator 32 comprises an elongated plug 154 having a head 156 reciprocally positioned in the inflator body 12 in alignment with the actuator pin 138 of the water-activated actuator assembly 22 in the tubular portion 20. The plug 154 is biased away from the elongated by means of the spring 132 being entrained between the sleeve 126 and the head 154 of the plug 154.

The head 156 of the plug 154 is preferably colored "green". The length of the plug 154 is such that when the spring-loaded actuator pin 138 is being held back into its cocked position by the bobbin 34, the green head 156 of the plug is in alignment with the indicator window 26, thereby representing an operable firing condition for the bobbin 34.

Conversely, upon firing of the inflator 10, the spring-loaded actuator pin 138 is released by the bobbin 34 and engages the plug 154 to force it axially within the body 12 to a position where the green head 156 thereof is no longer in view within the indicator window 26, thereby no longer indicating an operable position of the inflator 10.

Figure 27:
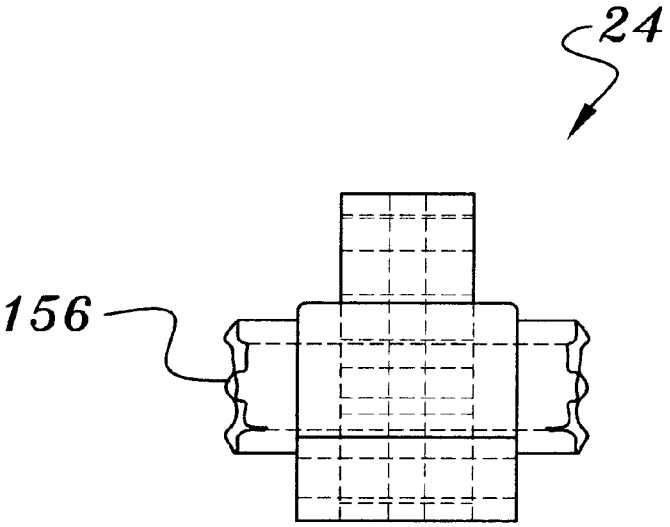
FIGS. 27 and 28 are side and end views, respectively, of the transfer lever preferably employed in the automatic inflator of the invention.
Figure 28:
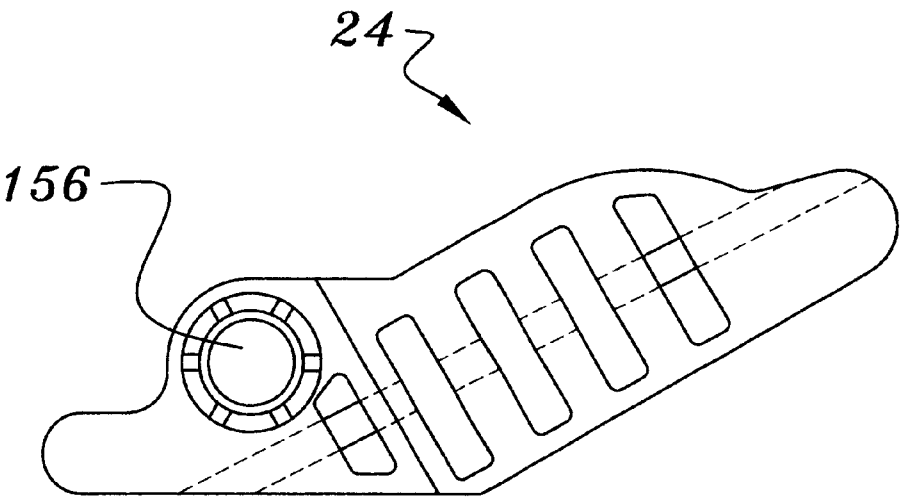

Transfer Lever (Component FIGS. 27–28 and Assembly FIGS. 1, 32 and 35)

Through a seesaw action, the transfer lever 24 functions to transfer axial movement, of the bobbin indicator plug 154 upon firing to the pierce pin shaft 46 to force the pierce pin 66 outwardly through the frangible seal of the gas cylinder 18 and cause firing of the same. More particularly, the transfer lever 24 comprises a pivot hole 158 for receiving a pivot pin 160 inserted through corresponding holes 162 formed in the opposing side walls 28 of the inflator body 12. A dust cap 162 may be secured by the pivot pin 160 about the opened end of the inflator body 12. The transfer lever 24 may be provided with a tab or ball lanyard 163 for manual inflation.

Figure 31:
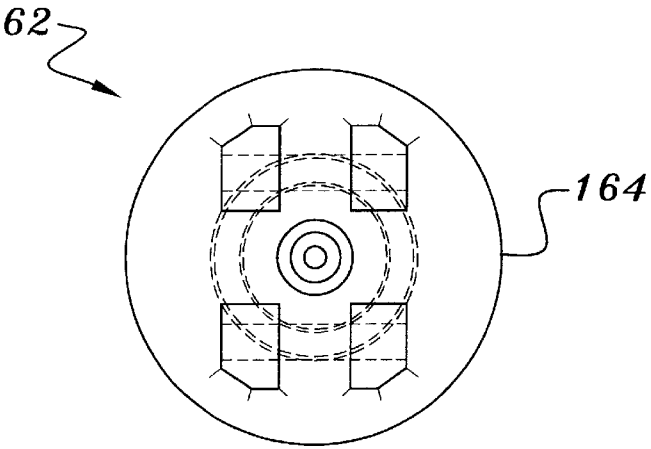
FIGS. 29, 30 and 31 are side and end views, respectively, of the exhaust manifold preferably employed in the automatic inflator of the invention.
Figure 29:
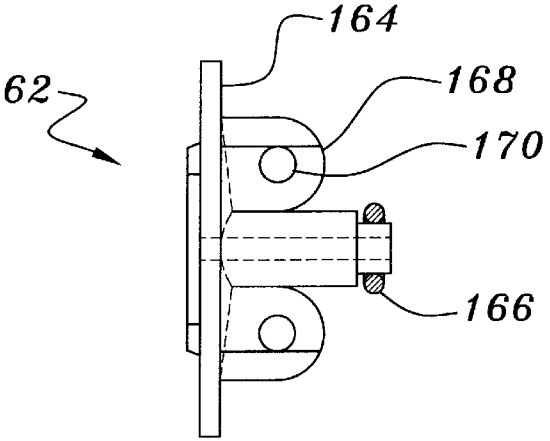
Figure 30:
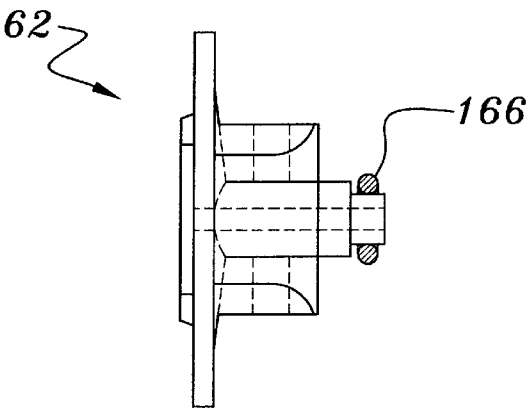

Exhaust Manifold (Component FIGS. 29–31 and Assembly FIG. 33)

The improved exhaust manifold 62 of the invention comprises a generally disk-shape configuration 164 having a protruding hollow tubular portion 166 dimensioned to sealingly engage into the exhaust hole 60 of the boss 14 of the inflator body 12. In this regard, the tubular portion 166 and correspondingly, the exhaust hole 60, may comprise complementary stepped configurations of increased and decreased diameters allowing an O-ring 166 to be positioned on the reduced diameter portion of the tubular portion 166 for sealing engagement with the reduced diameter portion of the exhaust hole 60 when the manifold 62 is mounted to the inflator body 10.

The mount may comprise of opposing ears 168 on the disk-shaped portion 164 of the exhaust manifold 62 that mate with complementary opposing ears 169 (or complementary opposing pairs of ears 169 as shown) formed on the exterior of the boss 14 of the inflator body 12. The ears 168 and 169 each having aligned holes 170 for receiving respective coupling pins or, as shown, a U-shaped coupling pin 172.

Importantly, the improved exhaust manifold 62 of the invention eliminates the need for the in situ molding of a metal schraeder valve assembly with the disk-shaped portion as typified by the prior art inflators. However, as in the case of the prior art, the disk-shaped portion may be easily sealingly connected to the article to be inflated.

Fully Operable Status (Assembly FIGS. 32–34)

When the automatic inflator 10 of the invention is fully operable with a charged gas cylinder 18 installed, with the cap 38 fully threaded into position and with an operable bobbin 34 installed, the gas cylinder indicator 30 is not indicating an inoperable condition because its reciprocating member 96 is fully retracted by means of the collar 44 of its cylinder adaptor 40 such that the red indicator shutter 100 is out of view of the indicator window 26 nor is the cap indicator 36 is indicating an inoperable condition because the window 134 of its sleeve 126 is aligned with the indicator window 26. Yet, the bobbin indicator 34 is indicating an operable condition because the green head 156 of its plug 154 is visible through the indicator window 26.

Figure 37:
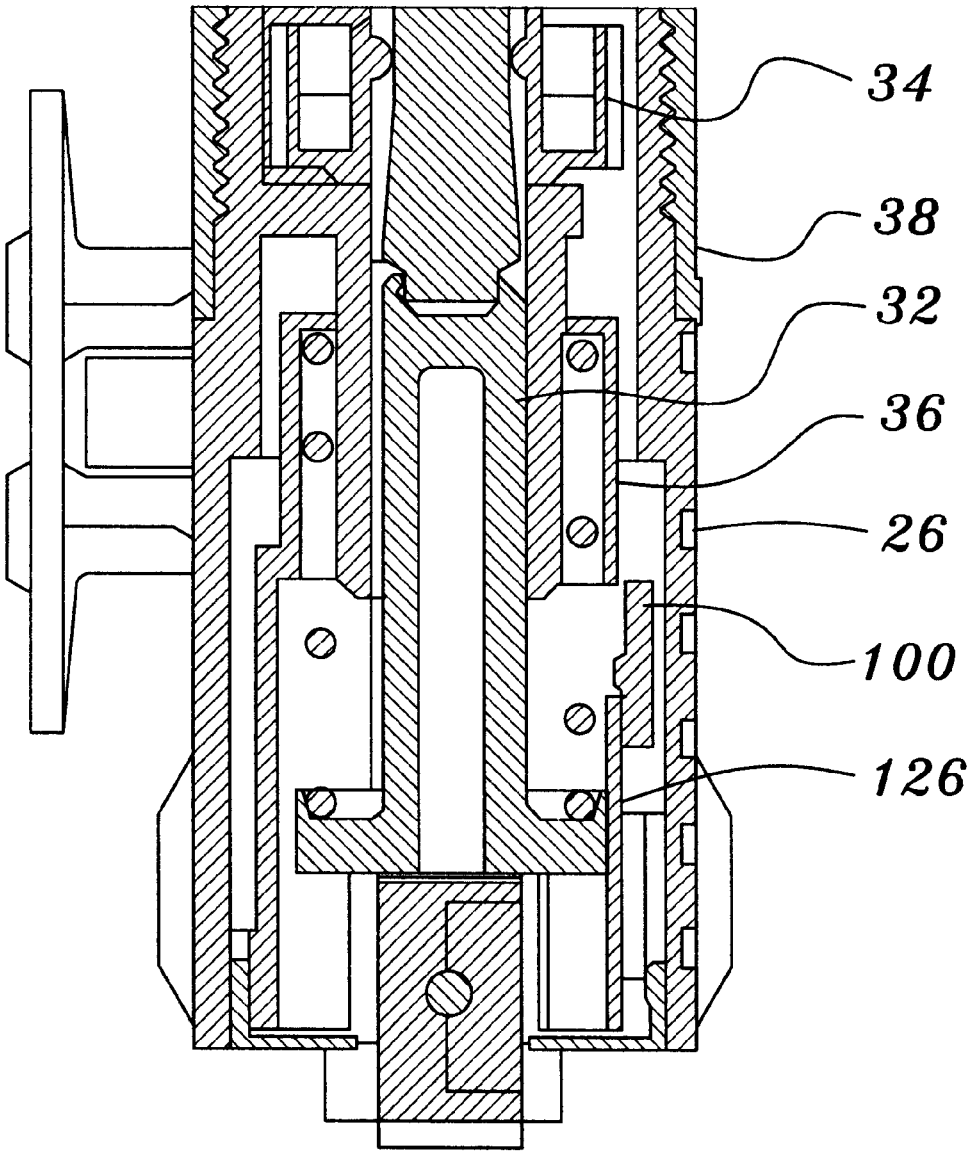

Inoperable Status Due to Firing (Assembly FIGS. 35–37)

When the automatic inflator 10 of the invention has been fired due to the failure of the bobbin 34, the lack of a bobbin 34 being installed or the manual firing (via the lanyard 24L) or automatic firing (upon submersion in water), the gas cylinder indicator 30 immediately indicates an inoperable condition because its reciprocating member 96 is fully extended such that the red indicator shutter 100 is in view of the indicator window 26. As the indicator shutter 100 constitutes the first layer visible through the indicator window 26, it takes priority to indicate an inoperable condition irrespective of the operational status of the cap indicator 36 indicating the cap 38 condition and irrespective of the bobbin indicator 32 indicating the bobbin 34 condition.

Figure 39:
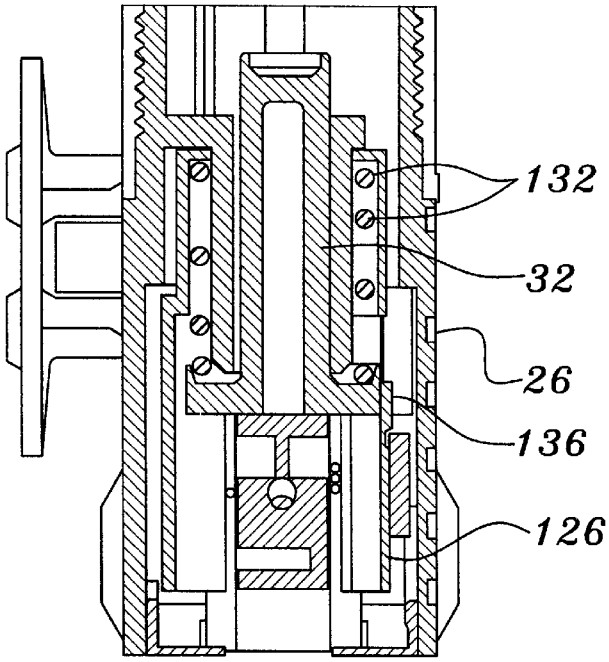
FIGS. 38 and 39 are cross-sectional views of the automatic inflator of the invention in a cap-off, inoperable condition.
Figure 38:
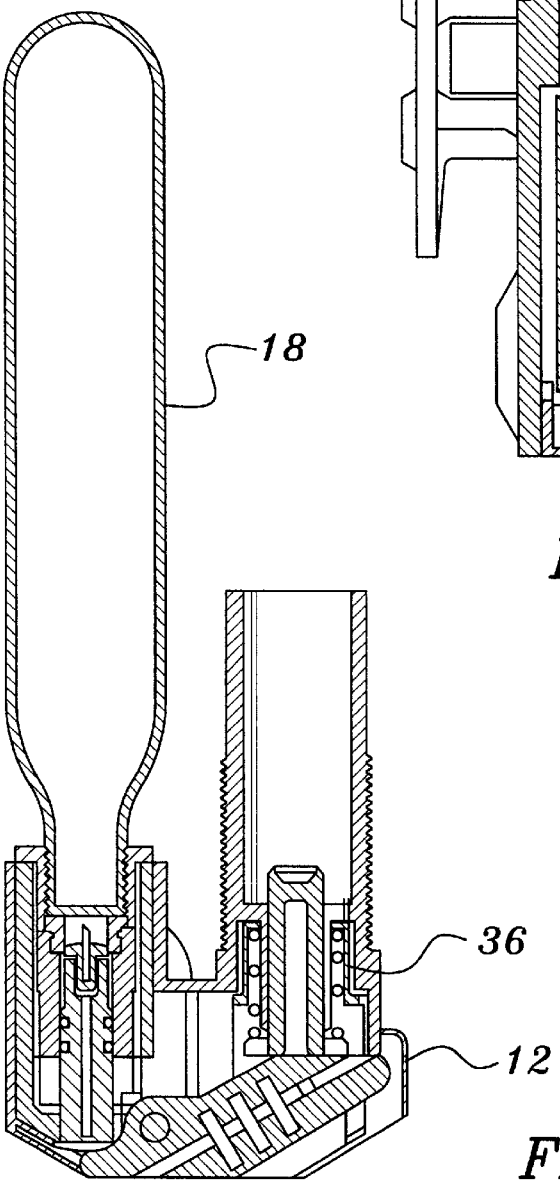

Inoperable Status Due to Cap-Off (Assembly FIGS. 38–39)

When the cap 38 is at least partially unthreaded, the cap indicator 36 indicates an inoperable condition because the red side 136 of its sleeve 126 comes into view in the indicator window 26. As the sleeve 126 constitutes the second layer visible through the indicator window 26, it takes priority over the bobbin indicator 32 to indicate an inoperable condition due to the loosed cap 38 irrespective of the operational status of the bobbin indicator 32 indicating the bobbin 34 condition.

Figure 42:
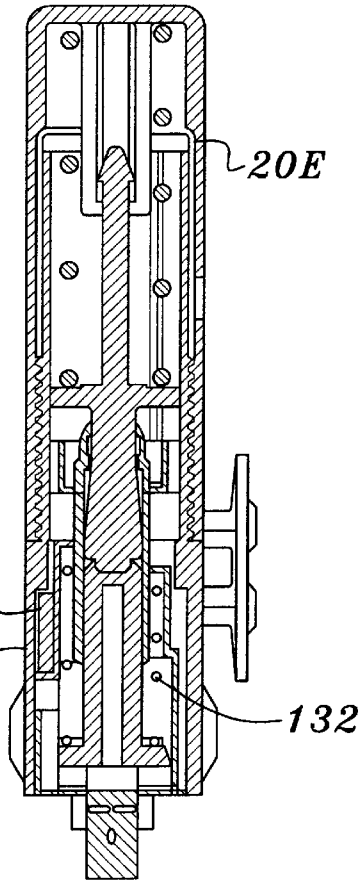
FIGS. 40, 41, 41A, and 42 are cross-sectional views of the automatic inflator of the invention in a fired, cylinder-off, inoperable condition.
Figure 41A:
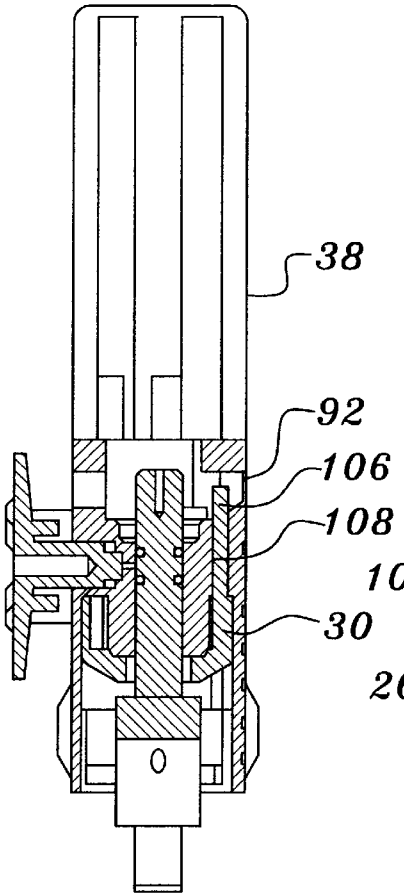
Figure 40:
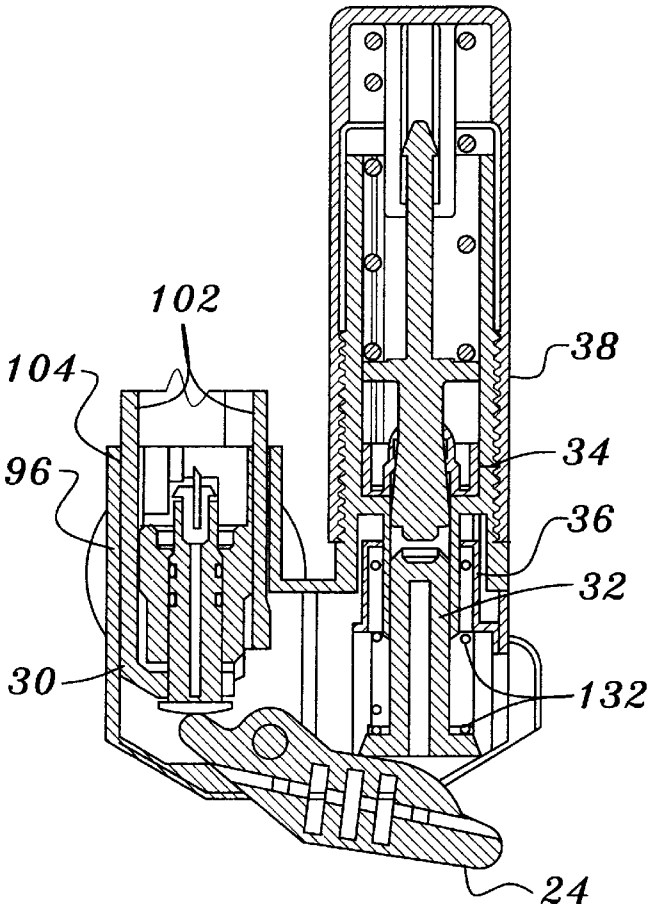

Inoperable Status Due to Cylinder Off (Assembly FIGS. 40–42)

When the gas cylinder 18 is removed, the gas cylinder indicator 30 indicates an inoperable condition because its reciprocating member 96 is urged by spring 132 via the transfer lever 24 to be fully extended whereupon the red indicator shutter 100 is in view of the indicator window 26. As noted above, because the indicator shutter 100 constitutes the first layer visible through the indicator window 26, it takes priority to indicate an inoperable cylinder-off condition irrespective of the operational status of the cap indicator 36 indicating the cap 38 condition and irrespective of the bobbin indicator 32 indicating the bobbin 34 condition.

An important feature of the invention is the fact that the cylinder indicator, the cap indicator and the bobbin indicator are functionally intercoupled to represent their respective status conditions through the indicator window. Consequently, the automatic inflator of the invention achieves a "single-point" status indication of the complete operational status of the inflator as well as the gas cylinder.

Now that the invention has been described,

What is claimed is:

1. An automatic inflator that indicates various operational modes of the inflator including whether a fully-charged, unspent gas cylinder has been installed to the automatic inflator and whether a cap of the automatic inflator has been fully installed, the inflator including a single point indicator window through which one color is displayed when said automatic inflator is fully operational and a different color is displayed either when a gas cylinder is not installed, when a spent gas cartridge is installed, when the cap is not fully installed, and when a bobbin is not installed, and when a spent bobbin is installed.

2. An inflator having a status indicator that indicates whether a fully-charged, unspent gas cylinder has been installed to said inflator, comprising in combination:

a cylinder adapter for mounting onto said neck of said gas cylinder, said cylinder adapter comprising a tubular configuration having bayonet lugs about an outer periphery and a fracturable collar about an inner end;

an inflator body comprising a boss with bayonet slots for receiving said bayonet lugs for coupling said cylinder adapter to said inflator body;

a reciprocating member mounted in axial alignment with said boss of said inflator body, said reciprocating member including upstanding arms that engage through corresponding holes in a longitudinal wall of said boss of said inflator body and are (1) forcibly retracted within said boss against a force of a spring by said fracturable collar of said cylinder adapter as said gas cylinder is bayonet-installed into said boss and (2), upon firing of said gas cylinder, forced outwardly from said boss to forcibly fracture said collar of said cylinder adapter.

3. The inflator as set forth in claim 2, wherein said reciprocating member includes an upstanding blocking arm that reciprocates within another hole in said longitudinal wall of said boss to move into a blocking position within said bayonet slot when said reciprocating member is forced forwardly upon firing thereby assuring that a spent said gas cylinder with a fractured collar is not reinstalled onto said inflator.

4. The inflator as set forth in claim 3, wherein said reciprocating member comprises includes a sidewise projecting shutter that moves from an obscured position across an indicator window formed in said body as said reciprocating member is forced forwardly upon firing.

5. The inflator as set forth in claim 4, wherein said shutter is colored to provide a visual indication of a fired condition via said indicator window.

6. The inflator as set forth in claim 3, wherein said upstanding arms and said upstanding blocking arm are colored to provide a visual indication of when said upstanding arms are in said extended position from said boss and when said blocking arm is blocking said bayonet slot.

7. An automatic inflator comprising in combination:

a bobbin indicator that indicates whether a fully-operable bobbin has been properly installed within said automatic inflator;

a cap indicator, overlaying said bobbin indicator, that indicates whether a threaded cap of said automatic inflator has been fully installed; and a single window aligned with said bobbin indicator and said cap indicator such that a portion of said cap indictor indicative of said threaded cap not being fully installed is visible through said window and such that, when said cap indicator is not obscuring said window, said bobbin indicator is visible through said window to indicate the operable condition of the bobbin.

8. An automatic inflator comprising in combination:

a bobbin indicator that indicates whether a fully-operable bobbin has been properly installed within said automatic inflator;

a cap indicator that indicates whether a threaded cap of said automatic inflator has been fully installed; and said bobbin indicator comprising a bobbin indicator plug with a colored head that is viewable through an indicator window of said inflator and wherein said cap indicator indicates when a threaded cap has been fully threaded onto a threaded tubular portion of said inflator, said cap indicator including an axial sleeve with tabs extending through corresponding holes formed in a lowermost portion of said threaded tubular portion such that as said threaded cap is fully threaded onto said threaded tubular portion, said protruding tabs are forced longitudinally inwardly and a sleeve window formed in said sleeve is moved into alignment with said indicator window of said inflator and when so aligned, said head of said bobbin indicator plug is viewable through said indicator window and through said aligned sleeve window whereas when said cap is at least partially unthreaded, said window of said sleeve is no longer in alignment and a side wall of said sleeve appears in said indicator window, thereby indicating an inoperable said inflator when said cap is not fully installed.

9. An inflator, comprising in combination:

a body portion;

a pierce pin shaft reciprocatingly mounted within a longitudinal bore in said body portion;

an exhaust hole formed through a wall of said longitudinal bore, said exhaust hole;

said pierce pin shaft being operatively mounting relative to a pierce pin for piercing a frangible seal of a gas cartridge installed in fluid communication with said longitudinal bore; and said pierce pin shaft including a pair of O-ring slots in which are positioned respective O-rings for sealing engagement with said longitudinal bore, said O-rings being positioned sufficiently apart to span said exhaust hole to prevent leakage of gas from an inflated article coupled in fluid communication with said exhaust hole through said longitudinal bore to the atmosphere when the gas cartridge is removed.

10. An automatic inflator having an elongated threaded cap that threadably engages an elongated tubular portion of an actuator body to achieve a tube-in-tube arrangement defining a tortuous path of water flow from outside of the inflator to a bobbin positioned within said tubular portion via apertures in a lower portion of said threaded cap, then upwardly along a lumen of said thread cap, then over an uppermost edge of said tubular portion, then downwardly along a lumen of said tubular portion to said bobbin thereby minimizing inadvertent actuation of said automatic inflator when exposed to wet conditions such as water splashes.

11. An improved inflator exhaust manifold for connecting an inflator to an article to be inflated, said exhaust manifold comprising a generally disk-shaped portion having a protruding hollow tubular portion dimensioned to sealingly engage into an exhaust hole of said inflator, at least one ear that mates with at least one complementary opposing ear formed on an exterior of said inflator body, said mating said ears each having at least one aligned hole for receiving a pin.

12. The exhaust manifold as set forth in claim 11, wherein said tubular portion comprises stepped configurations of an increased diameter portion and a decreased diameter portion and an O-ring positioned on said reduced diameter portion for sealing engagement with complementary reduced diameter portion of said exhaust hole of said inflator when said exhaust manifold is mounted therein.

13. An automatic inflator comprising a cap indicator for indicating when a threaded cap has been fully threaded onto a threaded tubular portion of said inflator, said cap indicator including an axial sleeve with tabs extending through corresponding holes formed in a lowermost portion of said threaded tubular portion such that as said threaded cap is fully threaded onto said threaded tubular portion, said protruding tabs are forced longitudinally inwardly to visually indicate when said threaded cap is fully threaded onto said threaded tubular portion.

14. A method for indicating the operating condition of an automatic inflator having a gas cylinder, a cap and a bobbin assembly through a single point window formed in the body of the inflator, comprising the sequential steps of:

if said gas cylinder is missing or if a discharged gas cylinder is installed, moving an upper-layer indicator shutter into alignment with said window to be visible through said window to indicate a first inoperable condition of said inflator; and if said cap is not fully threaded into position, moving a lower-layer indicator shutter into alignment with said window to be visible through said window if not otherwise obscured by said upper-layer indicator shutter to indicate a second inoperable condition of said inflator.

15. A method for indicating the operating condition of an automatic inflator having a gas cylinder, a cap and a bobbin assembly, comprising the steps of if said gas cylinder is missing or if a discharged gas cylinder is installed, displaying a red indicator shutter via a indicator window; irrespective of whether said red indicator shutter is moved out from view of said indicator window indicating that a charged gas cylinder is installed, displaying a red colored side of a sleeve in view in said indicator window to indicate an inoperable condition if said cap is not fully threaded into position; if said red indicator shutter is moved out from view of said indicator window indicating that a charged gas cylinder is installed, if said cap is fully threaded into position and if an operable said bobbin assembly is installed to hold-back an actuator pin in a cocked position, aligning a sleeve window of said sleeve with said indicator window allowing visualization of at least a portion of said bobbin assembly; and, upon firing of said inflator, said actuator pin forces said bobbin indicator pin inwardly to move said transfer lever which then forces said reciprocating member and its arms forwardly whereupon said red indicator shutter moves into view in said indicator window to indicate an inoperable condition of said inflator.

16. An automatic inflator having a single indicator window that indicates at least two operational modes of the inflator including whether a fully-charged, unspent gas cylinder has been installed to the automatic inflator and whether a cap of the automatic inflator has been fully installed, said single indicator window providing a single-point viewable indication of various operational modes of the inflator by displaying through said single indicator window a first indicator displaying a first color indicative of the inflator not being operational by having a spent gas cylinder; and a second indicator displaying either the first color or a second color indicative of the inflator not being operational by not having the cap fully installed, wherein said first indicator overlays said second indicator relative to the viewing thereof through said single indicator window to take priority over said second indicator.

* * * * *